US008961146B2

(12) United States Patent
Phillips et al.

(10) Patent No.: US 8,961,146 B2
(45) Date of Patent: Feb. 24, 2015

(54) ELECTRONICALLY CONTROLLED LIQUID DISPENSING SYSTEM WITH MODULAR TUBING AND POWER DESIGN

(75) Inventors: David L. Phillips, Santa Ana, CA (US); Humberto Valenzuela Meza, Tustin, CA (US); Jignesh N. Pandya, Vadodara (IN); Ujjaval D. Joshi, Gujarat (IN)

(73) Assignee: Flow Control LLC, Beverly, MA (US)

( * ) Notice: Subject to any disclaimer, the term of this patent is extended or adjusted under 35 U.S.C. 154(b) by 526 days.

(21) Appl. No.: 13/221,253

(22) Filed: Aug. 30, 2011

(65) Prior Publication Data

US 2012/0213644 A1 Aug. 23, 2012

Related U.S. Application Data

(60) Provisional application No. 61/378,185, filed on Aug. 30, 2010.

(51) Int. Cl.

| | |
|---|---|
| ***F04B 49/10*** | (2006.01) |
| ***B67D 1/00*** | (2006.01) |
| ***B67D 1/08*** | (2006.01) |
| ***B67D 1/12*** | (2006.01) |

(52) U.S. Cl.

CPC ..... *B67D 1/0004* (2013.01); *B67D 1/0888* (2013.01); *B67D 1/1247* (2013.01)

USPC ..... 417/44.1; 417/36

(58) Field of Classification Search

USPC ..... 417/36, 38, 40, 41, 44.1, 45, 44.2, 63, 417/413.1

See application file for complete search history.

(56) References Cited

U.S. PATENT DOCUMENTS

| | | | | |
|---|---|---|---|---|
| 3,667,022 | A | 5/1972 | Quinn | |
| 3,801,889 | A | 4/1974 | Quinn | |
| 3,861,363 | A | 1/1975 | Williams et al. | |
| 3,911,883 | A | 10/1975 | Williams et al. | |
| 3,973,539 | A | 8/1976 | Jones et al. | |
| 3,976,222 | A | 8/1976 | Spagnolo | |
| 4,265,598 | A | 5/1981 | Brand | |
| 4,269,059 | A * | 5/1981 | Baker | 73/863.03 |

(Continued)

FOREIGN PATENT DOCUMENTS

| | | |
|---|---|---|
| DE | 4103857 | 8/1992 |
| GB | 838526 | 6/1960 |

(Continued)

OTHER PUBLICATIONS 1 page English Language Abstract JP2009156047.

(Continued)

*Primary Examiner* — Bryan Lettman

(57) ABSTRACT

Apparatus is provided featuring a switch-mode power supply (SMPS) having a power circuit component in combination with a SMPS controller. The power circuit component may be configured to provide power to a pump that provides fluid from a container to some other device, including an appliance. The SMPS controller may be configured to receive signaling containing information about at least one control parameter selected from a group including a pressure at an outlet of the pump, a fluid level in the container and the temperature of a motor of the pump, and also may be configured to shut off the power provided to the pump based at least partly on the signaling received so that the power circuit component substantially does not draw power and heat up when the pump is shut off.

25 Claims, 9 Drawing Sheets

(56) References Cited

U.S. PATENT DOCUMENTS

| | | | | |
|---|---|---|---|---|
| 4,291,366 | A | 9/1981 | Nelson | |
| 4,516,911 | A | 5/1985 | Senghaas et al. | |
| 4,518,317 | A * | 5/1985 | Inoue | 417/45 |
| 5,051,609 | A | 9/1991 | Smith | |
| 5,076,761 | A | 12/1991 | Krohn et al. | |
| 5,092,302 | A | 3/1992 | Mohan | |
| 5,151,017 | A | 9/1992 | Sears et al. | |
| 5,577,890 | A | 11/1996 | Nielsen et al. | |
| 5,803,711 | A | 9/1998 | Schoenmeyer | |
| 5,831,837 | A | 11/1998 | Coyne et al. | |
| 5,860,790 | A | 1/1999 | Wang | |
| 6,315,523 | B1 | 11/2001 | Mills | |
| 6,322,443 | B1 * | 11/2001 | Jackson | 454/329 |
| 6,793,099 | B1 * | 9/2004 | Sleiman | 222/67 |
| 7,485,984 | B2 | 2/2009 | Fulks et al. | |
| 2004/0101424 | A1 * | 5/2004 | Nakazato | 417/413.1 |
| 2008/0251534 | A1 * | 10/2008 | Phillips et al. | 222/64 |
| 2009/0060751 | A1 | 3/2009 | Bourell, Jr. et al. | |
| 2009/0076661 | A1 | 3/2009 | Pearson et al. | |
| 2009/0213515 | A1 | 8/2009 | Phillips et al. | |
| 2009/0301482 | A1 * | 12/2009 | Burton et al. | 128/203.12 |

FOREIGN PATENT DOCUMENTS

| | | |
|---|---|---|
| GB | 1525924 | 9/1978 |
| JP | 2009156047 | 7/2009 |

OTHER PUBLICATIONS 1 page English Language Abstract DE4103857.

* cited by examiner

FIG. 7c: Wall Mounted XFMR

FIG. 7a: Wand Assembly

FIG. 7b: Float Assembly

ELECTRONICALLY CONTROLLED LIQUID DISPENSING SYSTEM WITH MODULAR TUBING AND POWER DESIGN

CROSS-REFERENCE TO RELATED APPLICATION

This application claims benefit to provisional patent application Ser. No. 61/378,185, filed 30 Aug. 2010, which is hereby incorporated by reference in its entirety.

BACKGROUND OF THE INVENTION

1. Field of the Invention

The present invention relates to a pump; and more particularly relates to a technique for controlling power to a pump in a liquid dispensing system.

2. Brief Description of Related Art

In the prior art, a conventional bottled water system includes a DC pump and mechanical pressure switch that shuts off the pump when certain pressure (i.e., the shut-off pressure) is exceeded. This pressure switch is typically connected in series with the transformer secondary winding; and the transformer is used to scale down the line voltage to the pump operation voltages. During the pump off condition, the transformer is still powered up, which leads to a power loss in the transformer and heating of the transformer, e.g., the transformer can typically be heated to about 120° F. and draws current constantly. Another issue relates to the motor inrush at the startup, which demands that a higher size transformer to be used.

Units are also known in the art that have a base unit that contains a pump and several electrical components internally installed. The base unit has an integral hose with a wand that is inserted into a bottled water container and draws the water into the pump. The outlet of the system is usually restricted down to be connected to an appliance such as a drink machine, refrigerator or similar appliance. With integral hoses fixed in place, any damage to these hoses requires either extensive rework or purchase of a new unit. The electronics are simple components with no filtering or protection of the circuits. This design also requires multiple models to accommodate different voltages used in the markets. Various models are required due to the units being hardwired with power cords to accommodate the numerous voltages and plugs used in the markets.

By way of example, FIGS. 1*a* and 1*b* are an illustration of a bottled water pump system disclosed in U.S. patent application Ser. No. 12/251,160, filed 14 Oct. 2008 (ITT/WFVA file nos. 07JAB003//911-12.17-2), which is hereby incorporated by reference in its entirety. The bottled water pump system features a dispenser or dispensing system configured to provide fluid from multiple reservoirs to an appliance or other suitable device; and a multiple tubing arrangement configured to couple the dispenser system and the multiple reservoirs of fluid. In operation, the multiple tubing arrangement are configured to respond to a vacuum provided from the dispenser system, and draw the fluid from the multiple reservoirs to the appliance, so as to deplete the multiple reservoirs at relatively equal amounts based on the Venturi effect.

Moreover, switched-mode power supply technology (also known as switching-mode power supply, SMPS, or simply switcher) is known in the art, and may take the form of an electronic power supply that incorporates a switching regulator in order to be highly efficient in the conversion of electrical power. Like other types of power supplies, an SMPS transfers power from a source like the electrical power grid to a load (e.g., a personal computer) while converting voltage and current characteristics. An SMPS is usually employed to provide a regulated output voltage, typically at a level different from the input voltage. Unlike a linear power supply, the pass transistor of an SMPS switches quickly (typically between 50 kHz and 1 MHz) between full-on and full-off states, which minimizes wasted energy. Voltage regulation is provided by varying the ratio of on to off time. In contrast, a linear power supply must dissipate the excess voltage to regulate the output. This higher efficiency is the chief advantage of an SMPS.

SUMMARY OF THE INVENTION

This present invention is directed towards the use of SMPS technology in relation to a liquid dispensing system, including, e.g., the aforementioned bottled water pump system similar to that shown in FIGS. 1*a* and 1*b*.

According to some embodiments, the present invention may take the form of apparatus, including a switched-mode power supply (SMPS), comprising a power circuit component in combination with a SMPS controller. The power circuit component may be configured to provide power to a pump that provides fluid from a container, e.g., a reservoir of fluid such as water, to some other device, including an appliance. The SMPS controller may be configured to receive signaling containing information about at least one control parameter selected from a group including a pressure at an outlet of the pump, a fluid level in the container and the temperature of a motor of the pump, and also may be configured to shut off the power provided to the pump based at least partly on the signaling received, so that the power circuit component substantially does not draw power and heat up when the pump is shut off.

According to some embodiment of the present invention, the apparatus may also include one or more of the following features:

The SMPS controller may include one or more signal processor or processing module having at least one processor and at least one memory including computer program code, where the at least one memory and computer program code are configured, with at least one processor, to cause the apparatus at least to receive the signaling containing information about the at least one control parameter and shut off the power provided to the pump based at least partly on the signaling received. The at least one memory and computer program code may also be configured, with at least one processor, to cause the apparatus at least to provide a control signal to shut off the power provided to the pump based at least partly on the signaling received.

The apparatus may include some combination of

- a pressure switch configured to sense the pressure at the outlet of the pump and provide a pressure switch signal containing information about the pressure at the outlet of the pump to the SMPS;
- a float switch configured to sense the fluid level in the container and provide a float switch signal containing information about the fluid level in the container to the SMPS; or
- a temperature cut-off switch configured to sense the temperature of the motor of the pump and provide a temperature cut-off switch signal containing information about the temperature of the motor of the pump to the SMPS.

The apparatus may include some combination of

- a pressure switch front-end filter circuit configured to filter the pressure switch signal, and a pressure switch signal conditioning circuit configured to condition and amplify a filtered pressure switch signal and provide a conditioned pressure switch signal;

a float switch front-end filter circuit configured to filter the float switch signal, an inverter logic circuit configured to invert a filter float switch signal, and a float switch signal conditioning circuit configured to condition and amplify a filtered and inverted float switch signal and provide a conditioned float switch signal; or a temperature cut-off switch front-end filter circuit configured to filter the temperature cut-off switch signal, and a temperature cut-off switch signal conditioning circuit configured to condition and amplify a filtered temperature cut-off switch signal and provide a conditioned temperature cut-off signal.

The apparatus may include an adder circuit configured to add the conditioned pressure switch signal, the conditioned float switch signal and the conditioned temperature cut-off signal and provide the signaling to the SMPS controller. The adder circuit may also be configured to work as an impedance matching in relation to the conditioned pressure switch signal, the conditioned float switch signal, the conditioned temperature cut-off signal and the signaling being provided the SMPS controller.

The SMPS may be configured with a pulse width modulation (PWM) controller having an internal switch, including an internal MOSFET switch, and a remote control function pin that receives remote on/off signaling that causes the internal switch to turn off the SMPS based at least partly on the signaling received.

The SMPS may be configured with a combination of an inrush current controller and a switch configured to control motor inrush at startup by providing a substantially smooth ramp-up voltage and to provide lock-rotor protection, dry run protection, over/under voltage protection, over/under current protection, leakage protection or over temperature protection.

The SMPS may be configured with a combination of a controller and a switch configured to provide direct ON-OFF software control to the pump and to provide the remote on/off signaling to be received by the remote control function pin of the PWM controller to shut off the power provided to the pump, based at least partly on the signaling received.

The SMPS may be configured with a combination of the PWM controller and an external MOSFET switch configured to allow scaling up of the SMPS.

The SMPS may be configured to form part of a base unit.

The pump may take the form of a direct current (DC) diaphragm pump.

The apparatus may take the form of a fluid dispensing system that includes, e.g., a wand assembly comprising a float assembly that responds to the fluid level in the container and provides a signal containing information about the fluid level in the container, e.g., via a float connector.

The SMPS controller may be configured as a printed circuit board assembly.

The SMPS controller may be configured to accommodate multiple voltages as a printed circuit board assembly.

The power circuit component may include circuitry and components configured to convert power based on alternately current into power based on direct current for providing to the pump.

The circuitry and components may include in some combination:

an electromagnetic interference (EMI) filter configured to provide electromagnetic filtering of the power based on alternately current;

a combination of a rectifier and input filter capacitor configured to rectify and filter the power based on alternately current into the power based on direct current;

a transformer configured to transform the voltage of the power based on direct current;

an output power filter configured to filter the power based on direct current;

a reference generator configured to provide a reference generator signal containing information about the power based on direct current; or an opto-coupler to optically couple the reference generator signal to the PWM controller.

The PWM controller may be configured to receive a transformer signal from one terminal of the transformer and remote on/off signaling, and to shut off the power provided to the pump based at least partly on information contained in these signals received.

The PWM controller may be configured to receive a transformer signal from one terminal of the transformer, a sensed voltage signal provided from another terminal of the transformer, remote on/off signaling and to shut off the power provided to the pump based at least partly on information contained in these signals received.

The PWM controller and/or the controller may also include a signal processor or processing module for implementing the aforementioned functionality consistent within that set forth herein.

The power based on alternately current may take the form of a voltage, e.g., in a range of about 85 to 265 volts and a frequency in a range of about 50-60 Hertz.

The power based on direct current may take the form of a voltage, e.g., of about 12 volts.

The apparatus may take the form of a wall mounted transformer having an enclosure configured to contain electronics for implementing the functionality of the power circuit component and the SMPS controller consistent with that set forth herein.

According to some embodiments, the present invention may also take the form of apparatus, e.g., such as an SMPS controller, that includes at least one processor and at least one memory including computer program code, where the at least one memory and computer program code are configured, with at least one processor, to cause the apparatus at least to:

receive signaling containing information about at least one control parameter selected from a group including a pressure at an outlet of the pump, a fluid level in the container and a temperature of a motor of the pump, and determine whether to shut off the power provided to the pump based at least partly on the signaling received, so that the power circuit component substantially does not draw power and heat up when the pump is shut off.

The at least one memory and computer program code may also be configured, with at least one processor, to cause the apparatus at least to shut off the power provided to the pump based at least partly on the signaling received, including by providing a control signal to shut off the power provided to the pump based at least partly on the signaling received.

In operation, the PWM controller with the internal MOSFET switch can allow for the designing of a low cost solution by reducing the component count. The remote control function may be used to switch off the SMPS in the case of a high pressure condition, a high temperature condition and/or a low water level condition. The pressure switch may sense the pressure at the outlet, the float switch may sense the water level in the bottle and the temperature sensor may sense the motor temperature. The outputs of these sensors may be conditioned and clubbed before sending to the remote function of the SMPS controller. The OR-stage may be configured to provide the signal to the remote control function pin when any of the above sensor signals goes high.

The SMPS in the design may be configured to work at about 132 kHz to reduce the transformer size. The use of low thermal impedance devices may reduce the size of the heat sinks. By way of example, the no load consumption is less than about 300 mW for the 230VAC.

The optional inrush controller may be configured to control the motor inrush at startup by providing a smooth ramp up in the voltage. This feature allows using a lower size or number of the components. An advanced algorithm of the inrush controller can provide features like lock-rotor protection, dry run protection, over voltage, over current, leakage, over temperature protection. The fault code will be displayed using an LED code.

The following advantages associated with the present invention as set forth below:

Universal input range (e.g., 85V-265V; 50/60 Hz).

Small size and low cost transformer.

Advanced SMPS technology.

Active control so low heat and power dissipation.

Output filter stage for providing a smooth output that increases pump life.

Controller switch goes into power saver mode when not in use, saves power.

No breaking of high current path for protection.

TCO, float switch and pressure switch used at low current.

No power relay needed.

Ease of manufacturability and assembly as all the connections will be with disconnect tab.

A printed circuit board assembly (PCBA) would be a press-fit or slide-in-locked with the enclosure.

Ecumenical advance algorithm.

Lesser flow variation with change in input voltages.

Rapid and swift response software algorithm with advanced and sophisticated on-board electronics control.

Extended pump life as advanced software assimilate and absorbs all the voltages higher than rated voltages going to the motor.

Subjugated heat generation in motor as a result of no voltages higher than rated one applied to pump.

Conserves water by having advanced leak detection feature.

On-board over temperature cut-off enhances the life of electronics and safe guards the product.

Array of self diagnostics features, such as run dry, lock rotor, leak detection, timeout, over voltage, under voltage, over current etc.

The SMPS controller may also form part of a pumping system, arrangement or configuration.

According to some embodiments, the present invention may be configured to provide a base unit that has an integrated PCBA and software that allows for one model to accommodate multiple voltages in one design. The inlet wand assembly and outlet connection may be separate and connected to the base unit via quick connect ports. These inlet and outlet ports can be of any configuration needed by the application. The use of the power socket design may allow for localized sourcing of power cords in the various markets using one base model.

In effect, the present invention sets forth a design and development of an improved bottled water system pump electronic controller that provides a solution to the transformer heating, transformer size, and higher power losses during the no load condition and also provides a workable solution for inrush current. Advanced SMPS technology is used to provide the power to the bottled water system DC diaphragm pump. In effect, the electronics provide constant power seamlessly to the pump when it is required, and provides very low power consumption during no-load condition. The advanced power switching devices provide for higher efficiencies.

BRIEF DESCRIPTION OF THE DRAWING

The drawing, which are not necessarily drawn to scale, includes the following Figures:

FIG. 7*b* showing a float assembly according to some embodiments of the present invention; and FIG. 7*c* showing a wall mounted transformer arrangement, including a pump, an enclosure, electronics and power cord, according to some embodiments of the present invention.

DETAILED DESCRIPTION OF THE INVENTION

Figure 2:
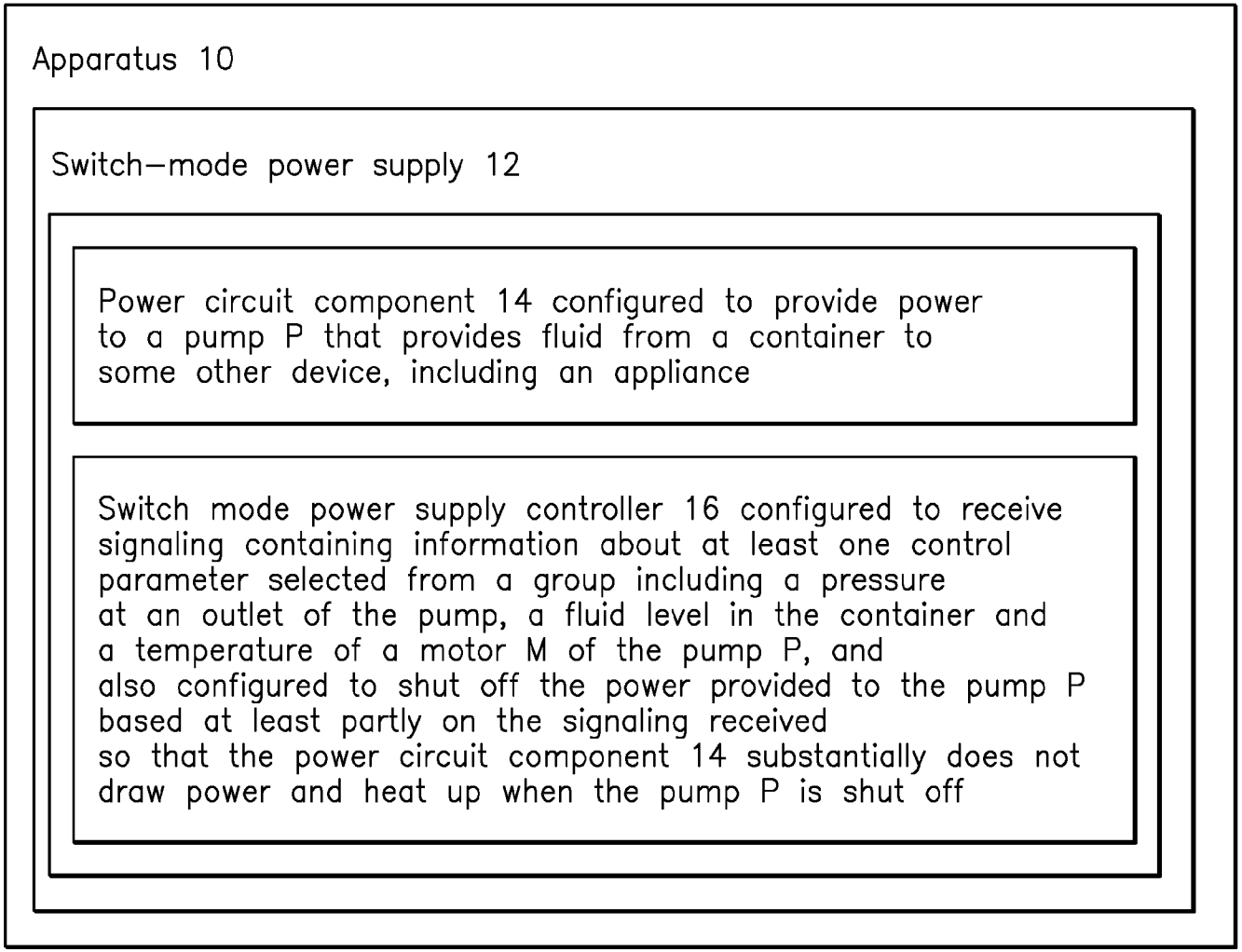
FIG. 2 is a diagram of apparatus, including an SMPS, according to some embodiments of the present invention.
Figure 3:
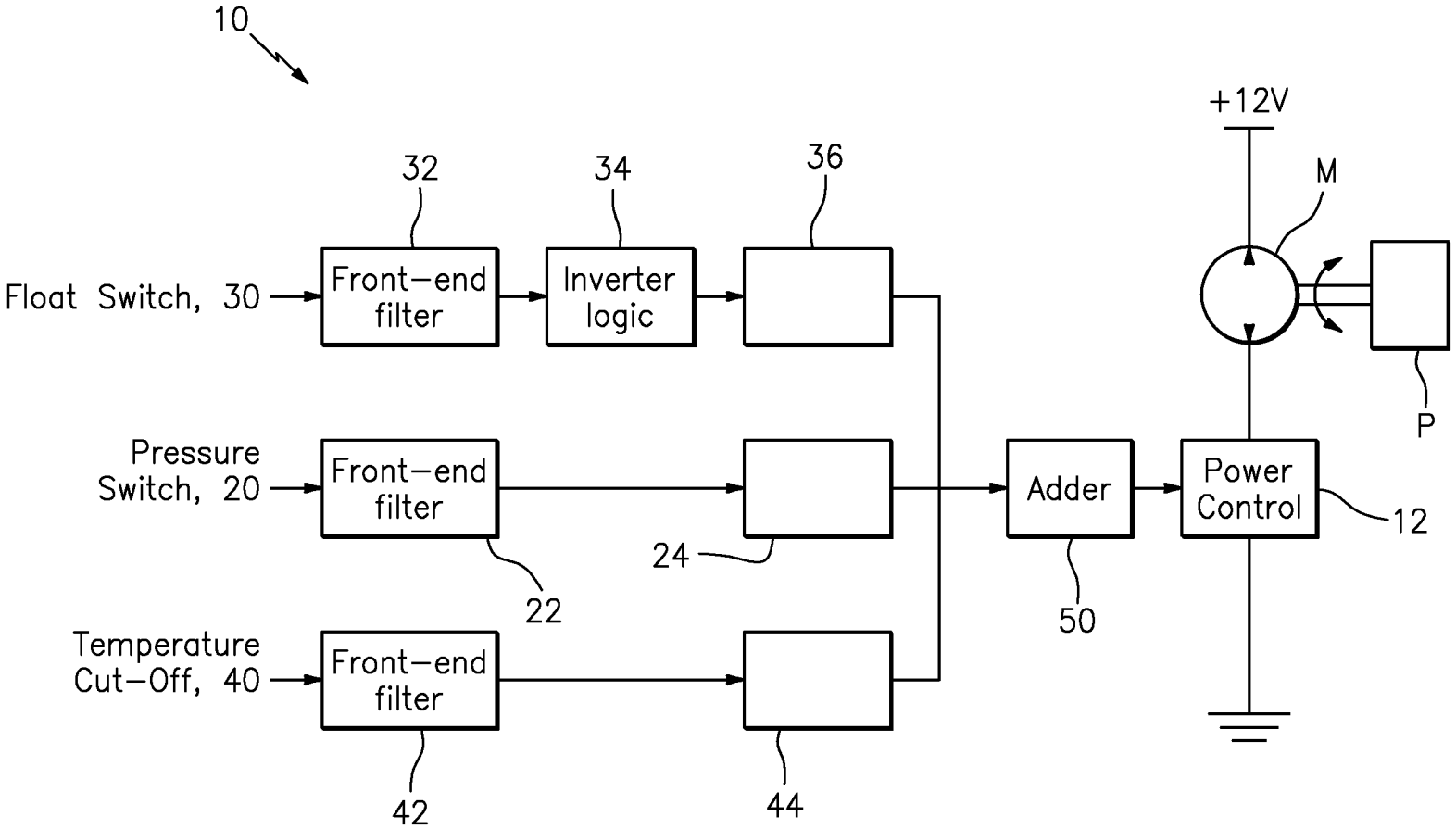
FIG. 3 is a diagram of apparatus, including an SMPS, according to some embodiments of the present invention.

FIGS. 2-3: The Main Concept

FIGS. 2-3 show the present invention in the form of apparatus generally indicated as 10 arranged in relation to a motor M that drives a pump P. By way of example, the pump P may be configured to form part of a liquid dispensing system, such as the bottled water system shown in FIGS. 1*a*, 1*b*.

As shown in FIG. 2, and according to some embodiment of the present invention, the apparatus 10 may take the form of, and may be configured as, a switch-mode power supply (SMPS) 12 having a power circuit component 14 in combination with an SMPS controller 16.

Figure 1A:
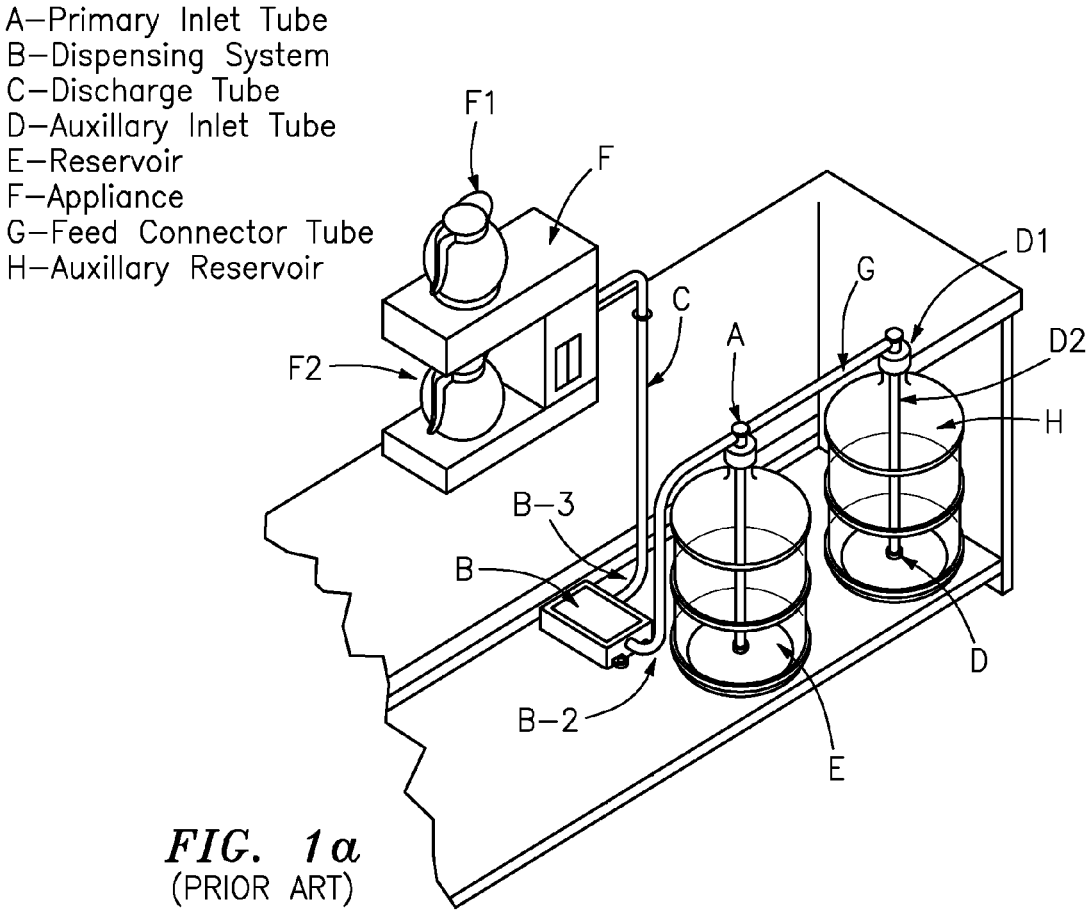
FIG. 1a (PRIOR ART)
FIG. 1*a* is a diagram of a bottle water system that is known in the art.
Figure 1B:
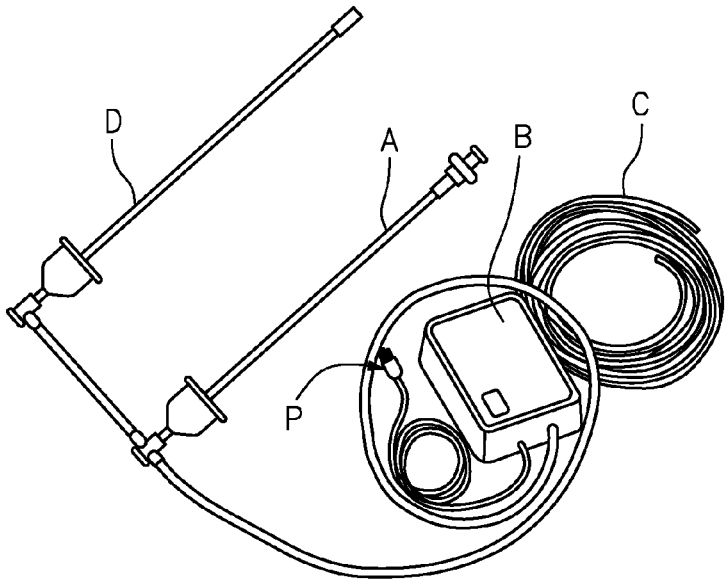
FIG. 1b (PRIOR ART)
FIG. 1*b* is a diagram of some basic parts of the bottle water system in FIG. 1*a* that is known in the art.

The power circuit component 14 may be configured to provide power to the pump P that provides fluid from a container to some other device, including an appliance that may form part of the bottled water system shown in FIGS. 1*a*, 1*b*.

The SMPS controller 16 may be configured to receive signaling containing information about at least one control parameter selected from a group including a pressure at an outlet of the pump P, a fluid level in the container and the temperature of the motor M of the pump P, and also may be configured to shut off the power provided to the pump P based at least partly on the signaling received, so that the power circuit component 14 substantially does not draw power and heat up when the pump P is shut off.

By way of example, and according to some embodiments of the present invention, the apparatus 10 may take the form of, and may be configured as, a switch-mode power supply (SMPS) 12 in combination with, and consistent with, that shown in FIG. 3. In FIG. 3, the apparatus 10 may be configured to include a pressure switch 20 configured to sense the pressure at the outlet of the pump P and provide a pressure switch signal containing information about the pressure at the outlet of the pump to the SMPS 12. The pressure switch signal may be processed by a pressure switch front-end filter circuit 22 configured to filter the pressure switch signal, and a pressure switch signal conditioning circuit 24 configured to condition and amplify a filtered pressure switch signal and provide a conditioned pressure switch signal.

The apparatus 10 may also be configured to include a float switch 30 configured to sense the fluid level in the container and provide a float switch signal containing information about the fluid level in the container to the SMPS 12. The float switch signal may be further processed by a float switch front-end filter circuit 32 configured to filter the float switch signal, an inverter logic circuit 34 configured to invert a filter float switch signal, and a float switch signal conditioning circuit 36 configured to condition and amplify the filtered and inverted float switch signal and provide a conditioned float switch signal.

The apparatus 10 may also be configured to include a temperature cut-off switch 40 configured to sense the temperature of the motor M of the pump P and provide a temperature cut-off switch signal containing information about the temperature of the motor M of the pump P to the SMPS 12. The temperature cut-off switch signal may be further processed by a temperature cut-off switch front-end filter circuit 42 configured to filter the temperature cut-off switch signal, and a temperature cut-off switch signal conditioning circuit 44 configured to condition and amplify the filtered temperature cut-off switch signal and provide a conditioned temperature cut-off signal.

As a person skilled in the art would appreciate, float switch inputs are typically logically inverted as a float switch typically has negative logic to work. In comparison, the other two input parameters typically are working on positive logic.

The signal conditioning and amplifying stage that makes the signal compatible for next (adder) stage. Signal conditioning stage may also be configured to work as non-inverting amplifier.

The apparatus 10 may also be configured to include an adder circuit 50 configured to add the conditioned pressure switch signal, the conditioned float switch signal and the conditioned temperature cut-off signal and provide the signaling to a power control 12, as shown in FIG. 3. According to some embodiments of the present invention, the SMPS 12 may take the form of, or form part of, the power control 12, consistent with that set forth and described in detail herein. By way of example, the power control 12 may be configured to perform the SMPS functionality set forth in relation to SMPS controllers shown in relation to FIGS. 4-6, as well as the electronics 102 shown in relation to FIG. 7.

The adder circuit 50 may also be configured to work as an impedance matching in relation to the conditioned pressure switch signal, the conditioned float switch signal and the conditioned temperature cut-off signal and provide the signaling to the SMPS controller. In operation, the adder stage adds up all the three inputs and makes an OR gate for power stage to operator (cut-off) if any or more than one input parameter is not normal, and also works as impedance matching.

The enabler for the pump P to run smoothly is the combination of the float switch input that tells, e.g., the bottle water system, if there is sufficient water available or not, the pressure switch input that tells the system if discharge pressure is under control and finally the temperature cut-off input that monitors the motor body temperature. Each one of these inputs are very sensitive and are prone to noise and other chattering effects, to minimize this, a powerful yet simple and low cost front end filter stage is provided and the start of each section, as set forth above.

The fundamental requirement of the bottle water system (BWS) is to supply bottled water as shown in FIGS. 1*a*, 1*b* when there is sufficient water in the bottle and pressure and temperature is under control.

To achieve this; a simple and low cost approach of analog electronics may be used consistent with that set forth herein.

The power stage may be configured with high end MOSFET circuitry that is capable of handling the total load current from the motor/pump to flow, as described below.

The advantages of this overall approach are that all the measuring parameters are on a low voltage low current stage and the components that are needed are of low power. Apart from that, the float switch may be arranged in close proximity to the container of fluid, e.g., water, may also be of low wattage, and may have a low current path, thus avoiding any chances of creating any danger to an operator.

FIGS. 4-6

Figure 4:
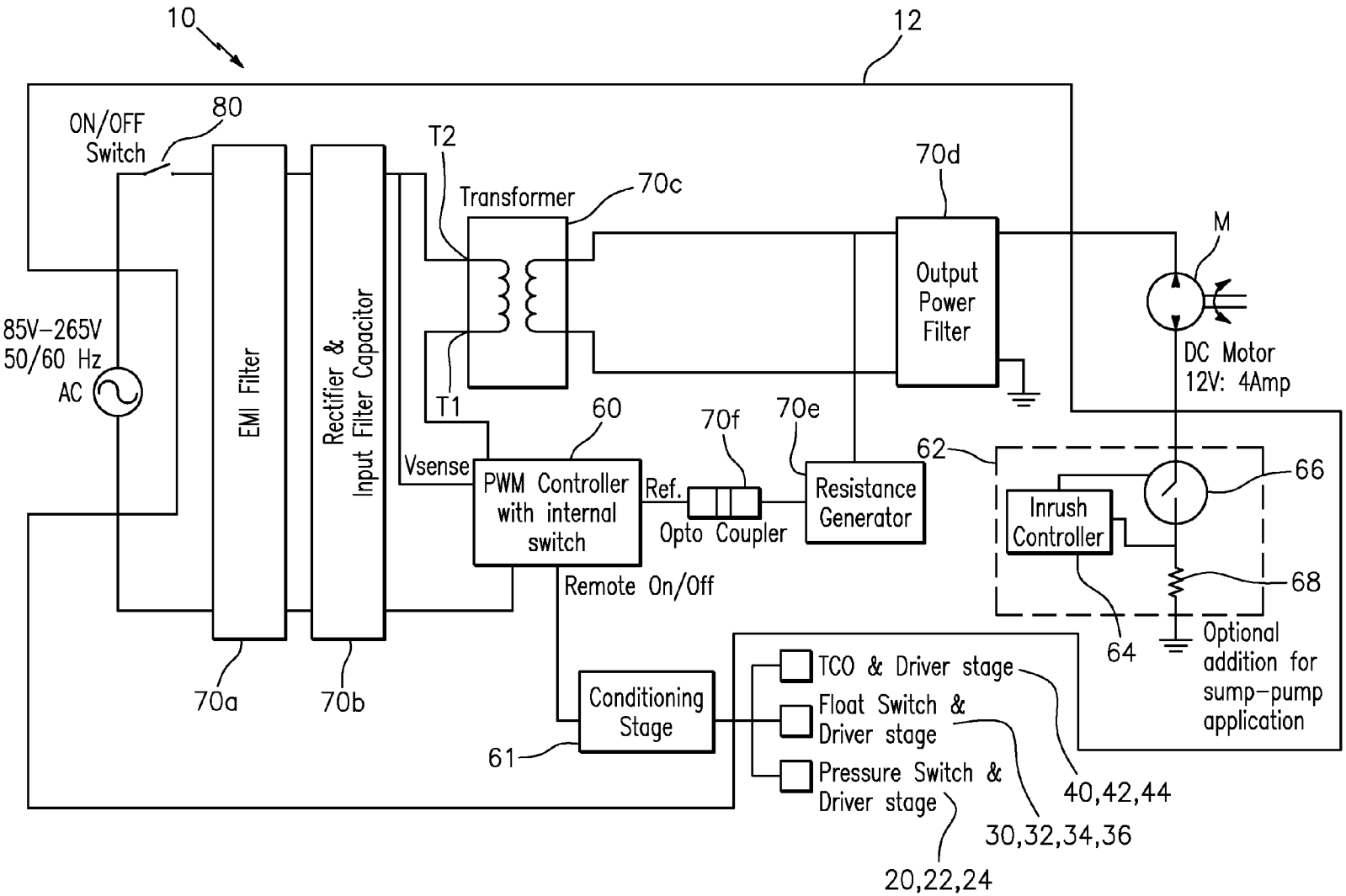
FIG. 4 is a diagram of apparatus, including an SMPS, according to some embodiments of the present invention.
Figure 5:
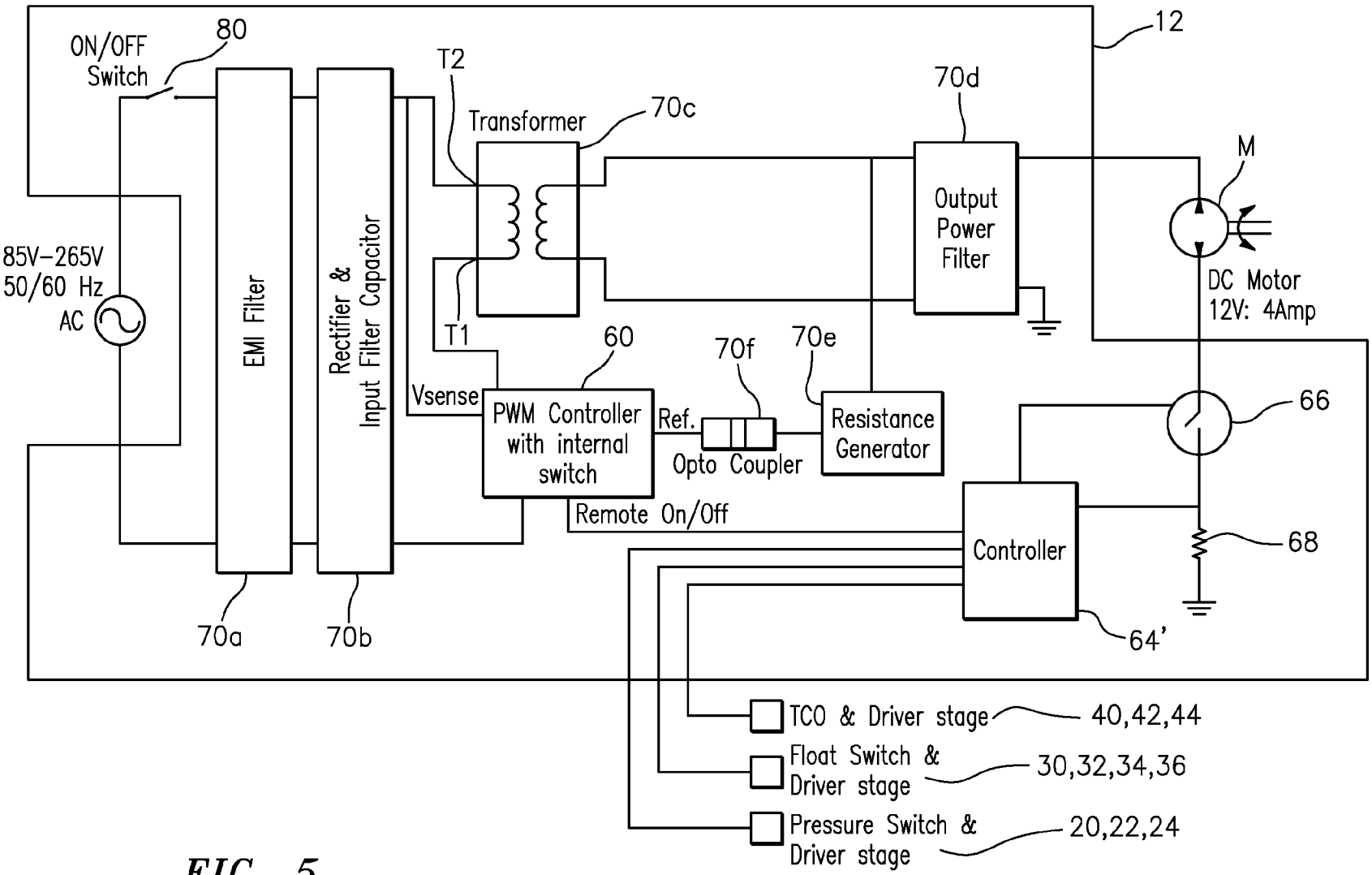
FIG. 5 is a diagram of apparatus, including an SMPS, according to some embodiments of the present invention.
Figure 6:
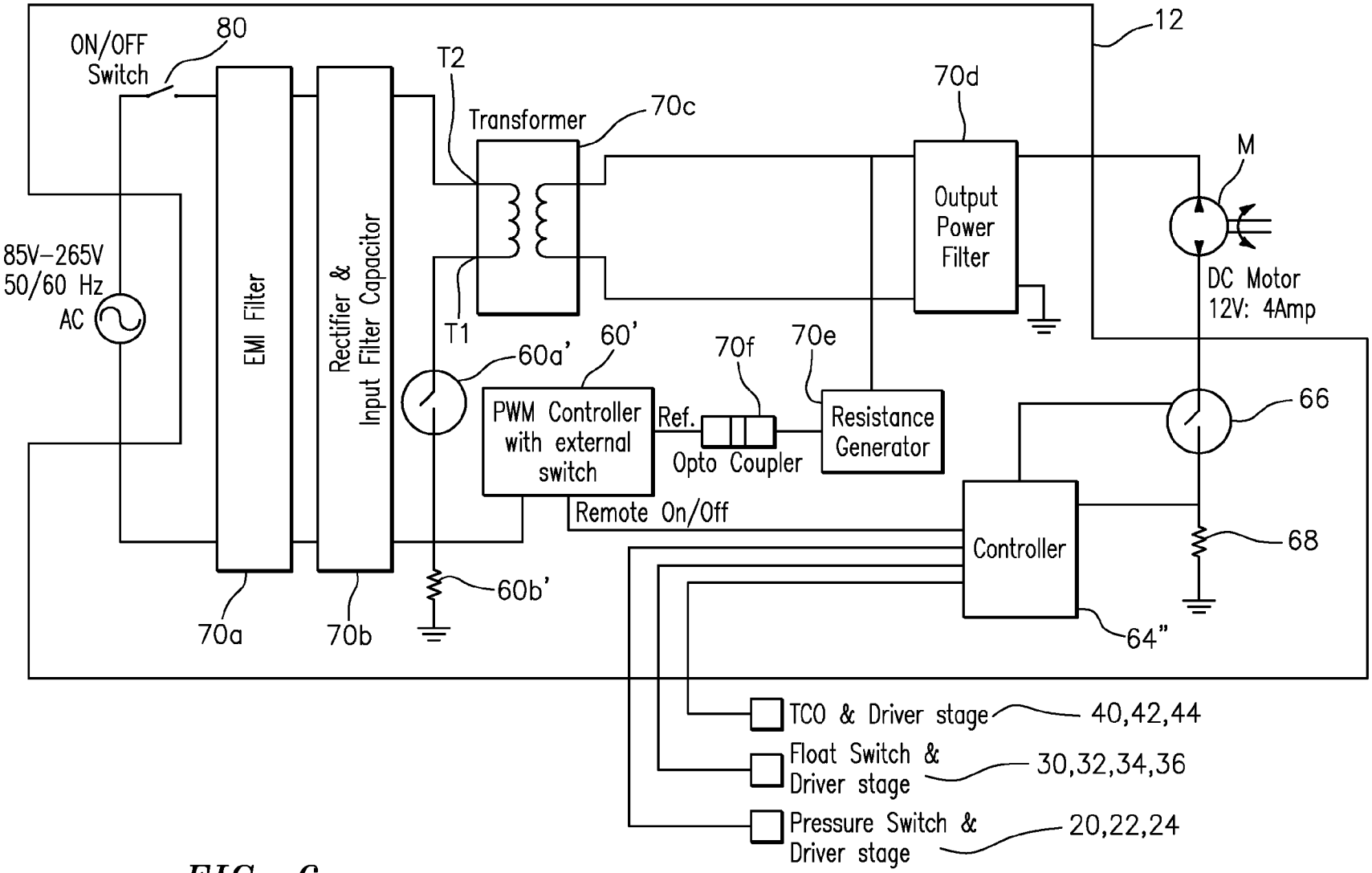
FIG. 6 is a diagram of apparatus, including an SMPS, according to some embodiments of the present invention.

This SMPS technology shown and described in relation to FIGS. 4-6 may be implemented in, or form part of, the design and development of a new bottled water system pump electronic controller shown in FIGS. 1*a*, 1*b*.

In operation, the electronics may be configured to provide constant power seamlessly to the pump P when it is required. The present invention provides a green mode feature in that it provides very low power consumption during no-load condition. The advanced power switching devices provides the higher efficiency.

Consistent with that set forth above, the known bottled water system includes one or more DC pumps and mechanical pressure switches that shut off the pump when certain pressure (i.e., the shut-off pressure) is exceeded. This pressure switch is typically connected in serial with the transformer secondary; the transformer is used to provide the scale down of the line voltage to the pump operation voltages. So, during the off condition, the transformer is still powered up. This condition leads to the power loss in the transformer and heating of the transformer. There is also an issue re the motor inrush at the startup which demands the higher size transformer to be used.

The present invention provides a solution to the prior art problems related to the transformer heating, transformer size, higher power losses during the no load condition and also provides a solution for the inrush current problem—in effect, by using advance SMPS technology to provide the power to, e.g., the bottled water system, including such a system having a DC diaphragm pump.

By way of example, FIGS. 4-6 show three different topologies configured with the aim of achieving all the above discussed features and advantages.

FIG. 4: The SMPS Controller with Internal MOSFET Switch

By way of example, and according to some embodiments of the present invention, the switch-mode power supply (SMPS) 12 may be configured as that shown in FIG. 4.

In FIG. 4, the SMPS 12 may be configured with a pulse width modulation (PWM) controller 60 having an internal switch, including an internal MOSFET switch, and a remote control function pin that receives remote on/off signaling that causes the internal switch to turn off the SMPS based at least partly on the signaling received, and consistent with that disclosed herein.

In operation, a controlling stage 61 is configured to receive the signaling from the pressure switch and driver stage 20, 22, 24; the float switch and drive state 30, 32, 34, 36; and the temperature cut-off and driver stage 40, 42, 44, and to provide the remote on/off signaling to the PWM controller 60 based at least partly on the signaling received. As shown, the PWM controller 60 may be configured to receive a transformer signal from one terminal T1 of the transformer 70*c*, a sensed voltage signal $V_{sense}$ from the other terminal T2 of the transformer 70*c*, and the remote on/off signaling from the controlling stage 61, and to shut off the power provided to the motor M of the pump P, based at least partly on information contained in these signals received. In particular, the PWM controller 60 may be configured to respond to the remote on/off signaling and shut off the power provided to the pump P based at least partly on the remote on/off signaling received, so that the power circuit component substantially does not draw power and heat up when the pump P is shut off.

The PWM controller 60 with internal MOSFET switch allows for the design of a low cost solution by reducing the component count. The remote control function may be used to switch off the SMPS 12 in the case of high pressure, high temperature and/or a low water level condition. Consistent with that shown and described in relation to FIG. 3, the pressure switch 40 senses the pressure at outlet, the float switch 30 senses the water level in the bottle and the temperature sensor 40 senses the motor temperature. The output of the above sensor are conditioned and clubbed before sending to the remote function of the SMPS controller. The OR-stage will provide the signal to the remote control function pin when any of the above sensor signal goes high.

According to some embodiments of the present invention, the PWM controller 60 and the controlling stage 61 may be configured with a signal processor or processing module for implementing the aforementioned functionality consistent within that set forth herein.

The SMPS 12 may also be configured with an optional inrush controller that may include a combination 62 of an inrush current controller 64, a switch 66 and a resistor 68, as shown, configured to control motor inrush at startup by providing a substantially smooth ramp-up voltage and to provide lock-rotor protection, dry run protection, over/under voltage protection, over/under current protection, leakage protection or over temperature protection. The control of the motor inrush at startup by providing the smooth ramp up in the voltage allows using a lower size of the components. The optional inrush controller may be implemented with an advance algorithm that can provide the features like the lock-rotor protection, the dry run protection, the over voltage, the over current, leakage, the over temperature protection. The optional inrush controller may be implement to provide fault code that can be displayed using the LED code as shown in the FIG. 9.

The power circuit component 14 may include circuitry and components configured to convert power based on alternately current (AC) into power based on direct current (DC). By way of example, in FIG. 4 the power based on alternately current may take the form of voltage in a range of about 85 to 265 volts and a frequency in a range of about 50-60 Hertz, and the power based on direct current may take the form of a voltage of about 12 volts, although the scope of the invention is not intended to be limited to any particular AC voltage, amperage, frequency, or DC voltage.

The circuitry and components may include in some combination:

an electromagnetic interference (EMI) filter 70*a*, configured to provide electromagnetic filtering of the power based on alternately current;

a combination of a rectifier and input filter capacitor 70*b* configured to rectify and filter the power based on alternately current into the power based on direct current;

a transformer 70*c* configured to transform the voltage of the power based on direct current;

an output power filter 70*d* configured to filter the power based on direct current;

a reference generator 70*e* configured to provide a reference generator signal containing information about the power based on direct current;

an opto-coupler 70*e* to optically couple the reference generator signal to the PWM controller; or an on/off manual toggle switch 80.

The aforementioned circuitry and components, and the implementation of the functionality associated with the same, is known in the art, and the scope of the invention is not intended to be limited to the type or kind thereof as either now known or later developed in the future.

The SMPS controller 12 may be configured to work at about 132 kHz to reduce the transformer size. The use of the low thermal impedance devices reduces the size of the heat sinks. The no load consumption is <300 mW for the 230VAC.

The SMPS controller 12 may also be configured to monitor the signaling received, e.g. using techniques based at least partly on current sensing, including sensing changes or differences in the signaling current.

FIG. 5: SMPS Controller 12 with Internal MOSFET Switch and Intelligent Pump Controller with Advance Diagnostic Feature By way of example, and according to some embodiments of the present invention, the switch-mode power supply (SMPS) 12 may be configured as that shown in FIG. 5. In FIGS. 4-5, similar elements are identified with similar reference numerals.

In FIG. 5, the SMPS 12 may be configured with a controller 64' coupled to a switch 66 to provide direct ON-OFF software control to the pump P based on the signal received and to provide the remote on/off signaling to be received by the remote control function pin of the PWM controller 60 to shut off the power provided to the pump based at least partly on the signaling received. Consistent with that discussed above, the SMPS controller 12 may be configured with the combination of the PWM controller 60 with an internal MOSFET switch allows designing low cost solution by reducing the component count. The controller 64' may be configured with a signal processor or processing module for implementing the aforementioned functionality consistent within that set forth herein.

In operation, the pump P is under the direct control of the software running in the controller 64', which will provide the ON-OFF control to the pump P in case of the high temperature, high pressure and low water level sensed by the respective sensors, and which will also provide the remote on/off signal to the remote control function pin of the PWM controller 60 to switch off the SMPS 12, consistent with that set forth and described herein. In particular, the PWM controller 60 may be configured to respond to the remote on/off signaling from the controller 64' and shut off the power provided to the pump P based at least partly on the remote on/off signaling received, so that the power circuit component substantially does not draw power and heat up when the pump P is shut off.

FIG. 6: SMPS Controller with External MOSFET Switch and Intelligent Pump Controller with Advance Diagnostic Feature By way of example, and according to some embodiments of the present invention, the SMPS 12 may be configured as that shown in FIG. 6. In FIGS. 4-6, similar elements are identified with similar reference numerals.

The SMPS 12 may be configured with a combination of a PWM controller 60' and an external MOSFET switch 60*a*' and a resistor 60*b*' configured to allow scaling up of the SMPS 12. The external MOSFET switch 60*a*' may be configured to allow scaling up the overall SMPS 12 in case of designs having higher requirements without affecting the main devices and design. The intelligent controller 64" may be configured to work substantially similarly as the controller 64' shown and described in relation to FIG. 5. Features of the embodiment shown in FIG. 6 may be used alone or in combination with features of the embodiment shown in FIG. 5, in order to implement the functionality of the underlying invention.

FIG. 7

Figure 7:
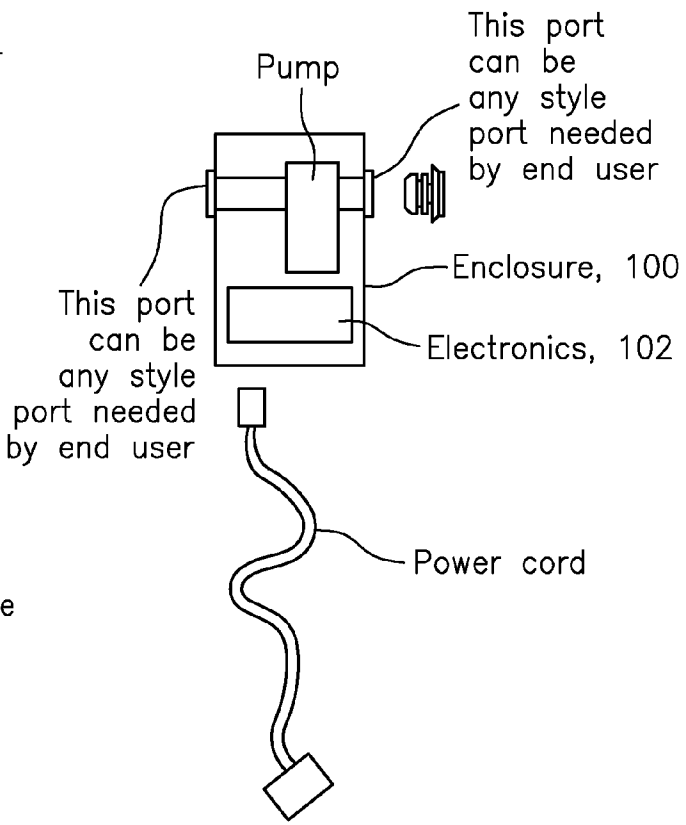
FIG. 7 includes FIG. 7*a* showing a wand assembly according to some embodiments of the present invention.
Figure 7:
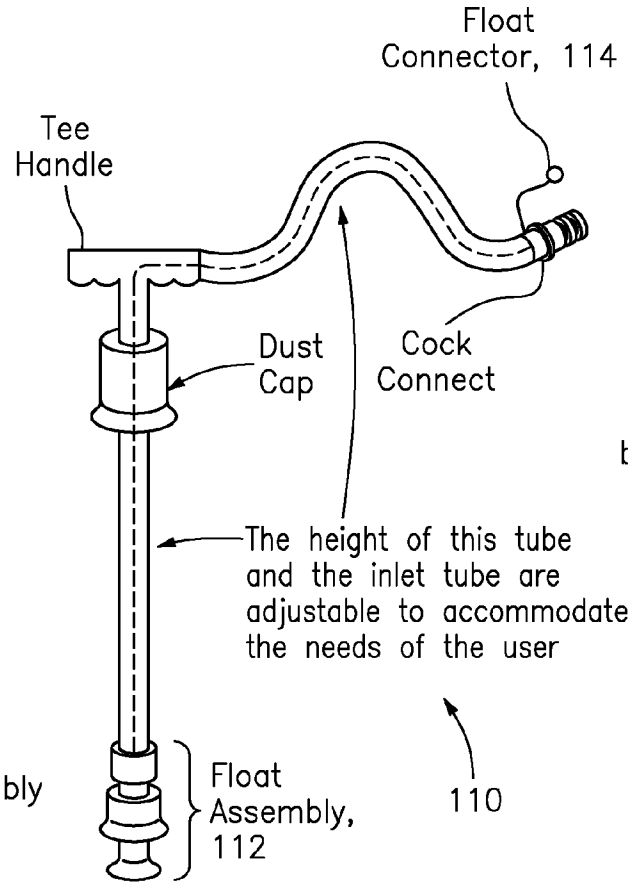
Figure 7:
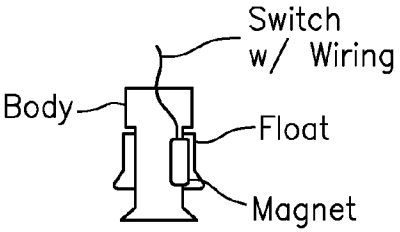

FIG. 7, including FIGS. 7*a*, 7*b*, 7*c*, shows some of the main concept of the present invention, in which the apparatus utilizes and may include a wall mounted plug transformer shown in FIG. 7*c* that will handle the AC to DC conversion. This wall mounted transformer will plug into, and form part of, an enclosure 100 to provide power to a pump.

In FIG. 7*c*, the enclosure 100 may be configured with electronics 102, e.g., in the form of a printed circuit board assembly (PCBA), internal that will route the power to the pump. The electronics 102 may be configured to receive one or more inputs, e.g., from the float switch as shown, as well as the temperature cut-off (TCO) and the pressure switch (See FIGS. 4-6) and provide a power output to the pump.

The apparatus 10 may take the form of, e.g., a fluid dispensing system like that shown in FIGS. 1*a* and 1*b*, that may be configured to include a wand assembly shown 110 in FIG. 7*a* that comprises a float assembly 112 that responds to the fluid level in the container and provides a float assembly signal containing information about the fluid level in the container via a float connector 114 coupled to the enclosure 100. The float assembly 112 is shown in further detail in FIG. 7*b*.

In operation, and consistent with that shown in FIG. 7, the float switch (FIGS. 7*a*, 7*b*) senses the fluid level in the fluid container and provides a float switch signal via the float connector (FIG. 7*a*) to the enclosure 100 (FIG. 7*c*). The electronics 102 (FIG. 7*c*) may be configured to monitor and respond to the float switch signal and to shut off the power provided to the pump P based at least partly on the float switch signal received, so that the power circuit component substantially does not draw power and heat up when the pump P is shut off. For example, if the float switch signal indicates that the fluid level in the fluid container is not acceptable, the electronics 102 (FIG. 7*c*) may be configured to turn off the power provided to the pump P, including embodiments where the PCBA turns off the power provided to the pump P. Alternatively, if the float switch signal indicates that the fluid level in the fluid container is acceptable, the electronics 102 (FIG. 7*c*) may be configured to continue to provide the power to the pump P. Moreover, if the power provided to the pump P has been turned off, then the electronics 102 (FIG. 7*c*) may also be configured to monitor and respond to the float switch signal and to turn back on the power provided to the pump P based at least partly on the float switch signal received. In this case, the power can be turned back on, e.g., when the float switch (FIGS. 7*a*, 7*b*) senses that the fluid level is acceptable and provides a float switch signal indicating the same to the electronics 102. By way of example, the fluid level may change from not being acceptable to being acceptable, e.g., when more fluid is added to the container to an acceptable level, or an empty container is replaced by a full container.

Further, the electronics 102 may be similarly configured to monitor and respond to input signals containing information related to the temperature cut-off (TCO) and the pressure switch (e.g., see FIGS. 2 and 4-6), and to provide a power output to the pump consistent with the functionality set forth above in relation to the processing of the float switch signal.

FIGS. 8-9

Figure 8:
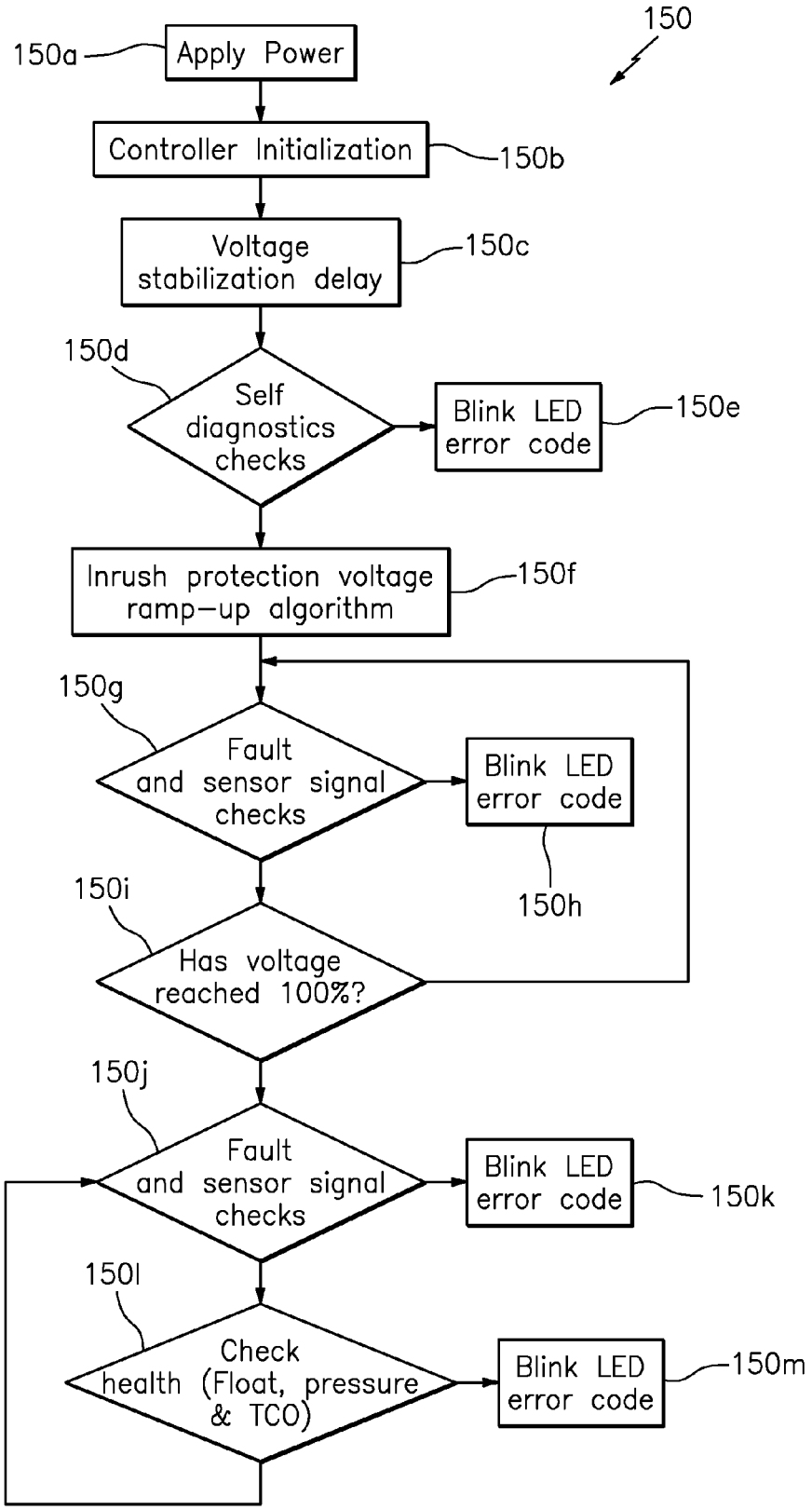
FIG. 8 is a diagram of a flow chart for implementing of an SMPS controller, according to some embodiments of the present invention.

By way of example, FIG. 8 shows a flowchart with steps generally indicated as 150 for implementing some embodiments of the present invention, including some combination of the following steps: a step 150*a* for applying power, a step 150*b* for controller initialization, a step 150*c* for voltage stabilization delay, a step 150*d* for a self diagnostics check, a step 150*e* for providing a blinking LED error code, a step 150*f* for implementing an inrush protection voltage ramp-up algorithm, a step 150*g* for fault and sensor signal checks, a step 150*h* for blinking an LED error code, a step 150*i* for determining if the voltage has reached 100%, a step 150*j* for fault and sensor signal checks, a step 150*k* for blinking an LED error code, a step for checking the health of (float, pressure and TCO), and a step 150*m* for blinking an LED error code.

Figure 9:
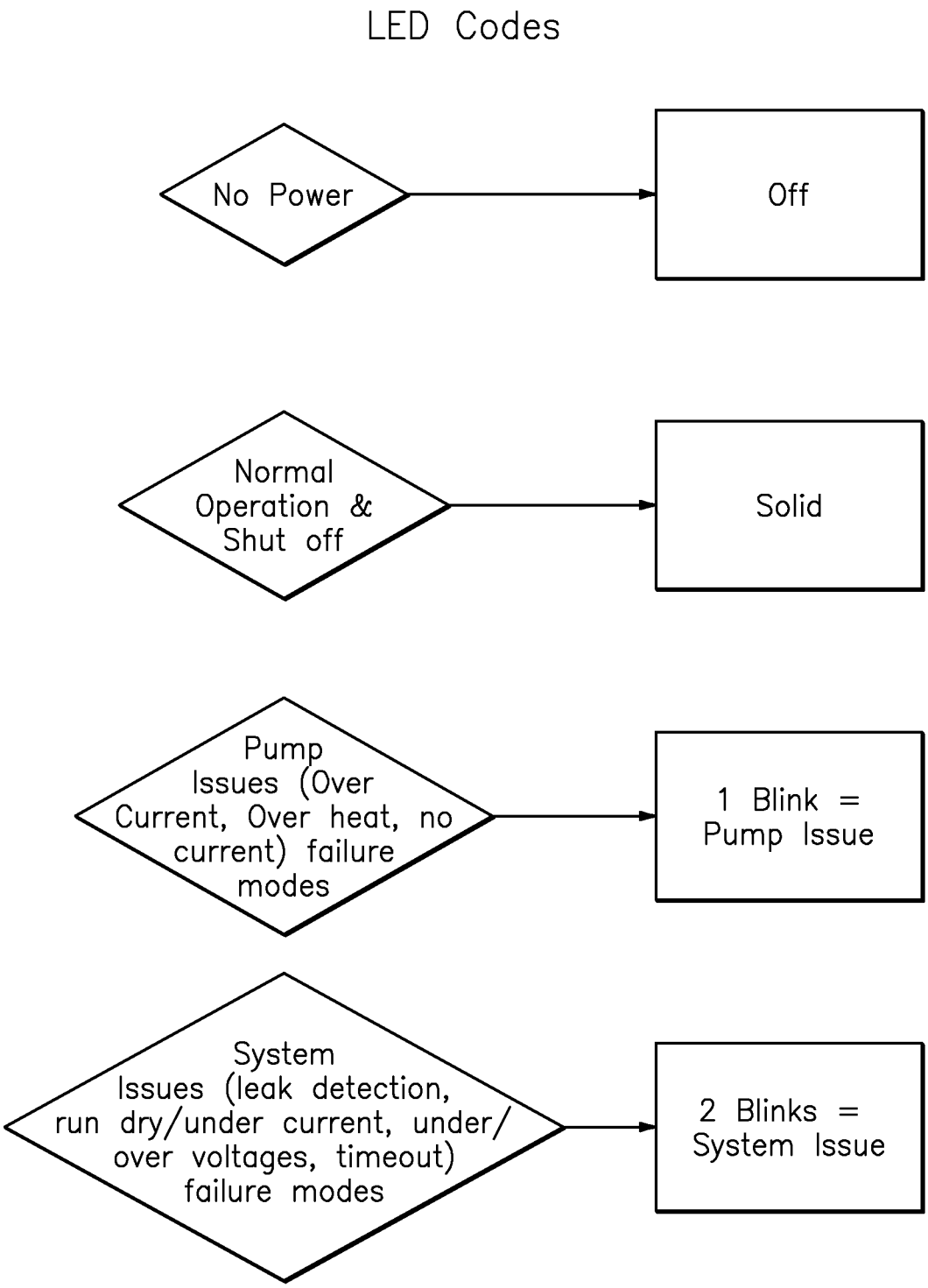
FIG. 9 is a diagram of a LED codes for implementing of an SMPS controller, according to some embodiments of the present invention.

By way of example, FIG. 9 shows LED codes for no power with the LED off, normal operation and shutoff with the LED solid, pump issues with the LED having 1 blink, and system issues with the LED having 2 blinks. The scope of the invention is intended to include using other types or kind of LED codes to differentiate these various conditions.

Implementation of the Functionality of the Signal Processor or Processing Module The functionality of the SMPS controller 16, the PWM controller 60, the controller 64, the inrush controller 64, the controller 64' and/or the controller 64" may be implemented in one or more signal processor or processing modules and may be configured using hardware, software, firmware, or a combination thereof, although the scope of the invention is not intended to be limited to any particular embodiment thereof. In a typical software implementation, a signal processor or processing module may take the form of one or more microprocessor-based architectures having a processor or microprocessor, a random access memory (RAM), a read only memory (ROM), where the RAM and ROM together form at least part of a memory for storing a computer program code, input/output devices and control, data and address buses connecting the same. A person skilled in the art would be able to program such a microprocessor-based implementation with the computer program code to perform the functionality described herein without undue experimentation. The scope of the invention is not intended to be limited to any particular implementation using technology either now known or later developed in the future. Moreover, the scope of the invention is intended to include the signal processor or processing module being a stand alone module, or in some combination with other circuitry for implementing another module. Moreover still, the scope of the invention is not intended to be limited to any particular type or kind of signal processor or processing module used to perform the signal processing functionality, or the manner in which the computer program code is programmed or implemented in order to make the signal processor operate.

The signal processor or processing module may include one or more other sub-modules for implementing other functionality that is known in the art, but does not form part of the underlying invention per se, and is not described in detail herein. For example, the functionality of the one or more other modules may include the techniques for the receiving signaling, provisioning of signaling for activating, deactivating or controlling the pump based on certain processing control functionality, including providing the signal automatically, providing the signal after a certain time period, etc., that can depend on a particular application for a particular customer.

Applications

Applications for the present invention are broadly understood to include any application that requires liquid to be transferred from one point, device or container to another point, device or container.

The Scope of the Invention

Further still, the embodiments shown and described in detail herein are provided by way of example only; and the scope of the invention is not intended to be limited to the particular configurations, dimensionalities, and/or design details of these parts or elements included herein. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What we claim is:

1. A switch-mode power supply, comprising:

a power circuit component configured to provide power to a pump that provides fluid from a container to some other device, including an appliance; and a switch mode power supply controller having an electronic switch, including a MOSFET switch, coupled to the power circuit component to turn off the switch-mode power supply, configured to receive signaling containing information about at least one control parameter selected from a group including a pressure at an outlet of the pump, a fluid level in the container and a temperature of a motor of the pump, and also configured to turn off the electronic switch, and shut off the switch-mode power supply and the power provided from the power circuit component to the pump based at least partly on the signaling received, so that the power circuit component substantially does not draw power and heat up when the pump is shut off.

2. A switch-mode power supply according to claim 1, wherein the switch mode power supply controller comprises a signal processor or processing module having at least one processor and at least one memory including computer program code, where the at least one memory and computer program code are configured, with at least one processor, to cause the switch-mode power supply at least to receive the signaling containing information about the at least one control parameter and shut off the power provided to the pump based at least partly on the signaling received.

3. A switch-mode power supply according to claim 2, wherein the at least one memory and computer program code are also configured, with at least one processor, to cause the switch-mode power supply at least to provide a control signal to shut off the power provided to the pump based at least partly on the signaling received.

4. A switch-mode power supply according to claim 1, wherein the switch-mode power supply comprises some combination of a pressure switch configured to sense the pressure at the outlet of the pump and provide a pressure switch signal containing information about the pressure at the outlet of the pump to the switch mode power supply;

a float switch configured to sense the fluid level in the container and provide a float switch signal containing information about the fluid level in the container to the switch mode power supply; or a temperature cut-off switch configured to sense the temperature of the motor of the pump and provide a temperature cut-off switch signal containing information about the temperature of the motor of the pump to the switch mode power supply.

5. A switch-mode power supply according to claim 4, wherein the switch-mode power supply comprises some combination of a pressure switch front-end filter circuit configured to filter the pressure switch signal, and a pressure switch signal conditioning circuit configured to condition and amplify a filtered pressure switch signal and provide a conditioned pressure switch signal;

a float switch front-end filter circuit configured to filter the float switch signal, an inverter logic circuit configured to invert a filter float switch signal, and a float switch signal conditioning circuit configured to condition and amplify a filtered and inverted float switch signal and provide a conditioned float switch signal; or a temperature cut-off switch front-end filter circuit configured to filter the temperature cut-off switch signal, and a temperature cut-off switch signal conditioning circuit configured to condition and amplify a filtered temperature cut-off switch signal and provide a conditioned temperature cut-off signal.

6. A switch-mode power supply according to claim 5, wherein the switch-mode power supply comprises an adder circuit configured to add the conditioned pressure switch signal, the conditioned float switch signal and the conditioned temperature cut-off signal and provide the signaling to the switch mode power supply.

7. A switch-mode power supply according to claim 1, wherein the switch mode power supply controller is configured with a pulse width modulation (PWM) controller having an internal electronic switch, and a remote control function pin that receives remote on/off signaling that causes the internal electronic switch to turn off the switch mode power supply based at least partly on the signaling received.

8. A switch-mode power supply according to claim 7, wherein the switch-mode power supply comprises a combination of a controller and a switch configured to provide direct ON-OFF software control to the pump based on the signal received and to provide the remote on/off signaling to be received by the remote control function pin of the PWM controller to shut off the power provided to the pump based at least partly on the signaling received.

9. A switch-mode power supply according to claim 1, wherein the switch-mode power supply comprises a combination of an inrush current controller and a switch configured to control motor inrush at startup by providing a substantially smooth ramp-up voltage and to provide lock-rotor protection, dry run protection, over/under voltage protection, over/under current protection, leakage protection or over temperature protection.

10. A switch-mode power supply according to claim 1, wherein the switch mode power supply controller forms part of a base unit.

11. A switch-mode power supply according to claim 1, wherein the pump is a direct current (DC) diaphragm pump.

12. A switch-mode power supply according to claim 1, wherein the switch-mode power supply forms part of a fluid dispensing system further that comprises a wand assembly comprising a float assembly that responds to the fluid level in the container and provides a signal containing information about the fluid level in the container via a float connector.

13. A switch-mode power supply according to claim 1, wherein the switch mode power supply controller is configured as a printed circuit board assembly.

14. A switch-mode power supply according to claim 1, wherein the switch mode power supply controller is configured to accommodate multiple voltages as a printed circuit board assembly.

15. A switch-mode power supply according to claim 1, wherein the power circuit component comprises circuitry and components configured to convert power based on alternating current into power based on direct current.

16. A switch-mode power supply according to claim 15, wherein the circuitry and components comprises in some combination:

an electromagnetic interference (EMI) filter configured to provide electromagnetic filtering of the power based on alternately current;

a combination of a rectifier and input filter capacitor configured to rectify and filter the power based on alternately current into the power based on direct current;

a transformer configured to transform the voltage of the power based on direct current;

an output power filter configured to filter the power based on direct current;

a reference generator configured to provide a reference generator signal containing information about the power based on direct current; or an opto-coupler to optically couple the reference generator signal to the PWM controller.

17. A switch-mode power supply according to claim 16, wherein the switch-mode power supply comprises a PWM controller configured to receive a transformer signal from one terminal of the transformer and remote on/off signaling, and to shut off the power provided to the pump based at least partly on information contained in these signals received.

18. A switch-mode power supply according to claim 16, wherein the PWM controller is also configured to receive a transformer signal from one terminal of the transformer, remote on/off signaling, a sensed voltage signal provided from the combination of the rectifier and input filter capacitor to another terminal of the transformer and to shut off the power provided to the pump based at least partly on information contained in these signals received.

19. A switch-mode power supply according to claim 1, wherein the power based on alternately current takes the form of voltage in a range of about 85 to 265 volts and a frequency in a range of about 50-60 Hertz.

20. A switch-mode power supply according to claim 1, wherein the power based on direct current takes the form of a voltage of about 12 volts.

21. A switch-mode power supply Apparatus-according to claim 1, wherein the power circuit component is configured to convert power based on the alternating current into power based on direct current for providing to the pump.

22. A switch-mode power supply according to claim 1, wherein the switch-mode power supply takes the form of a wall mounted plug transformer having an enclosure configured to contain electronics for implementing the functionality of the power circuit component and the SMPS controller.

23. A switch-mode power supply, including a switch-mode power supply, comprising:

a power circuit component configured to provide power to a pump that provides fluid from a container to some other device, including an appliance; and a switch mode Dower supply controller configured to receive signaling containing information about at least one control parameter selected from a group including a pressure at an outlet of the pump, a fluid level in the container and a temperature of a motor of the pump, and also configured to shut off the power provided to the pump based at least partly on the signaling received, so that the power circuit component substantially does not draw power and heat up when the pump is shut off;

wherein the apparatus comprises some combination of a pressure switch configured to sense the pressure at the outlet of the pump and provide a pressure switch signal containing information about the pressure at the outlet of the pump to the switch mode power supply;

a float switch configured to sense the fluid level in the container and provide a float switch signal containing information about the fluid level in the container to the switch mode power supply; or a temperature cut-off switch configured to sense the temperature of the motor of the pump and provide a temperature cut-off switch signal containing information about the temperature of the motor of the pump to the switch mode power supply;

wherein the apparatus comprises some combination of a pressure switch front-end filter circuit configured to filter the pressure switch signal, and a pressure switch signal conditioning circuit configured to condition and amplify a filtered pressure switch signal and provide a conditioned pressure switch signal;

a float switch front-end filter circuit configured to filter the float switch signal, an inverter logic circuit configured to invert a filter float switch signal, and a float switch signal conditioning circuit configured to condition and amplify a filtered and inverted float switch signal and provide a conditioned float switch signal; or a temperature cut-off switch front-end filter circuit configured to filter the temperature cut-off switch signal, and a temperature cut-off switch signal conditioning circuit configured to condition and amplify a filtered temperature cut-off switch signal and provide a conditioned temperature cut-off signal;

wherein the apparatus comprises an adder circuit configured to add the conditioned pressure switch signal, the conditioned float switch signal and the conditioned temperature cut-off signal and provide the signaling to the switch mode power supply; and wherein the adder circuit is configured to work as an impedance matching in relation to the conditioned pressure switch signal, the conditioned float switch signal and the conditioned temperature cut-off signal and provide the signaling to the switch mode power supply.

24. A switch mode power supply controller for coupling to a power circuit component of a power supply, comprising:

an electronic switch, including a MOSFET switch, coupled to the power circuit component to turn off the power supply;

at least one processor; and at least one memory including computer program code;

the at least one memory and computer program code are configured, with at least one processor, to cause the switch mode power supply controller at least to:

receive signaling containing information about at least one control parameter selected from a group including a pressure at an outlet of the pump, a fluid level in the container and a temperature of a motor of the pump, and determine whether to turn off the electronic switch, and shut off the power provided from the power circuit component to the pump based at least partly on the signaling received, so that the power circuit component substantially does not draw power and heat up when the pump is shut off.

25. Apparatus according to claim 24, wherein the at least one memory and computer program code are also configured, with at least one processor, to cause the switch mode power supply controller at least to provide a control signal to turn off the electronic switch, and shut off the power provided to the pump based at least partly on the signaling received.

* * * * *